US010602777B2

(12) United States Patent
Dickens et al.

(10) Patent No.: US 10,602,777 B2
(45) Date of Patent: Mar. 31, 2020

(54) AEROSOL PROVISION SYSTEM

(71) Applicant: NICOVENTURES HOLDINGS LIMITED, London (GB)

(72) Inventors: Colin Dickens, London (GB); Marina Trani, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 31 days.

(21) Appl. No.: 15/328,938

(22) PCT Filed: Jul. 17, 2015

(86) PCT No.: PCT/GB2015/052084
§ 371 (c)(1),
(2) Date: Jan. 25, 2017

(87) PCT Pub. No.: WO2016/012769
PCT Pub. Date: Jan. 28, 2016

(65) Prior Publication Data

US 2017/0215476 A1 Aug. 3, 2017

(30) Foreign Application Priority Data

Jul. 25, 2014 (GB) ..... 1413259.1

(51) Int. Cl.
*A24F 47/00* (2020.01)
*A24B 15/167* (2020.01)

(52) U.S. Cl.
CPC ..... *A24F 47/008* (2013.01); *A24B 15/167* (2016.11)

(58) Field of Classification Search
CPC ..... A24F 47/008; A24F 47/00; A24F 47/002; A24F 47/006; A24F 47/004; A24B 15/167; A24B 15/16; H05B 2203/021; H05B 1/0297; H05B 3/40; H05B 3/46; H05B 3/34; A61M 15/06; A61M 2205/3653;
(Continued)

(56) References Cited

U.S. PATENT DOCUMENTS 2,057,353 A 10/1936 Whittemore, Jr.
2,809,634 A 10/1957 Murai
3,111,396 A 11/1963 Ball
(Continued)

FOREIGN PATENT DOCUMENTS

AT 508244 12/2010
AU 63931/73 6/1975
(Continued)

OTHER PUBLICATIONS

Australian Examination Report, Application No. 2015293686, dated Jul. 25, 2018, 6 pages.
(Continued)

*Primary Examiner* — Shawntina T Fuqua
(74) *Attorney, Agent, or Firm* — Patterson Thuente Pedersen, P.A.

(57) ABSTRACT

An aerosol provision system comprises a liquid storage area comprising a liquid formulation; an aerosol generating area; and a membrane disposed between the liquid storage area and the aerosol generating area, the membrane fluidly communicating the liquid storage area with the aerosol generating area, wherein the liquid formulation has a water content of at least 18% w/w.

13 Claims, 4 Drawing Sheets

(58) Field of Classification Search
CPC ..... A61M 2205/8206; A61M 11/042; H01M 2/08; H01M 2/1055; H01M 2220/30
See application file for complete search history.

(56) References Cited

U.S. PATENT DOCUMENTS

| | | | |
|---|---|---|---|
| 3,402,724 | A | 9/1968 | Blount et al. |
| 3,431,393 | A | 3/1969 | Katsuda |
| 3,433,632 | A | 3/1969 | Elbert et al. |
| 3,521,643 | A | 7/1970 | Toth |
| 3,604,428 | A | 9/1971 | Moukaddem |
| 3,804,100 | A | 4/1974 | Fariello |
| 3,964,902 | A | 6/1976 | Fletcher et al. |
| 4,009,713 | A | 3/1977 | Simmons et al. |
| 4,031,906 | A | 6/1977 | Knapp |
| 4,094,119 | A | 6/1978 | Sullivan |
| 4,145,001 | A | 3/1979 | Weyenberg |
| 4,161,283 | A | 7/1979 | Hyman |
| 4,193,513 | A | 3/1980 | Bull |
| 4,503,851 | A | 3/1985 | Brauroth |
| 4,588,976 | A | 5/1986 | Jaselli |
| 4,676,237 | A | 6/1987 | Wood et al. |
| 4,735,217 | A | 4/1988 | Gerth et al. |
| 4,830,028 | A | 5/1989 | Lawson |
| 4,848,374 | A | 7/1989 | Chard et al. |
| 4,885,129 | A | 12/1989 | Leonard et al. |
| 4,917,301 | A | 4/1990 | Munteanu |
| 4,922,901 | A | 5/1990 | Brooks et al. |
| 4,947,874 | A | 8/1990 | Brooks et al. |
| 4,947,875 | A | 8/1990 | Brooks et al. |
| 4,978,814 | A | 12/1990 | Honour |
| 5,027,837 | A | 7/1991 | Clearman |
| 5,046,514 | A | 9/1991 | Bolt |
| 5,060,671 | A | 10/1991 | Counts et al. |
| 5,095,647 | A | 3/1992 | Zobele |
| 5,095,921 | A | 3/1992 | Losee et al. |
| 5,099,861 | A | 3/1992 | Clearman et al. |
| 5,121,881 | A | 6/1992 | Lembeck |
| 5,167,242 | A | 12/1992 | Turner et al. |
| 5,179,966 | A | 1/1993 | Losee |
| 5,247,947 | A | 9/1993 | Clearman et al. |
| 5,322,075 | A | 6/1994 | Deevi et al. |
| 5,388,574 | A | 2/1995 | Ingebrethsen |
| 5,390,864 | A | 2/1995 | Alexander |
| 5,479,948 | A | 1/1996 | Counts et al. |
| 5,497,792 | A | 3/1996 | Prasad |
| 5,501,236 | A | 3/1996 | Hill |
| 5,505,214 | A | 4/1996 | Collins et al. |
| 5,540,241 | A | 7/1996 | Kim |
| 5,553,791 | A | 9/1996 | Alexander |
| 5,636,787 | A | 6/1997 | Gowhari |
| 5,649,554 | A | 7/1997 | Sprinkel et al. |
| 5,666,977 | A | 9/1997 | Higgins et al. |
| 5,692,291 | A | 12/1997 | Seetharama |
| 5,743,251 | A | 4/1998 | Howell et al. |
| 5,865,185 | A | 2/1999 | Collins et al. |
| 6,095,505 | A | 8/2000 | Miller |
| 6,155,268 | A | 12/2000 | Takeuchi |
| 6,275,650 | B1 | 8/2001 | Lambert |
| 6,652,804 | B1 | 11/2003 | Neumann et al. |
| 6,681,998 | B2 | 1/2004 | Sharpe et al. |
| 6,701,921 | B2 | 3/2004 | Sprinkel et al. |
| 6,790,496 | B1 | 9/2004 | Levander et al. |
| 7,100,618 | B2 | 9/2006 | Dominguez |
| 7,112,712 | B1 | 9/2006 | Ancell |
| 7,263,228 | B2 | 8/2007 | Meyer |
| 7,400,940 | B2 | 7/2008 | McRae et al. |
| 7,540,286 | B2 | 6/2009 | Cross |
| 7,767,698 | B2 | 8/2010 | Warchol |
| 7,832,410 | B2 | 11/2010 | Hon |
| 7,992,554 | B2 | 8/2011 | Radomski et al. |
| 8,156,944 | B2 | 4/2012 | Hon |
| 8,365,742 | B2 | 2/2013 | Hon |
| 8,375,957 | B2 | 2/2013 | Hon |
| 8,393,331 | B2 | 3/2013 | Hon |
| 8,430,106 | B2 | 4/2013 | Potter et al. |
| 8,490,628 | B2 | 7/2013 | Hon |
| 8,511,318 | B2 | 8/2013 | Hon |
| 8,752,545 | B2 | 6/2014 | Buchberger |
| 8,689,805 | B2 | 8/2014 | Hon |
| 8,833,364 | B2 | 9/2014 | Buchberger |
| 8,948,578 | B2 | 2/2015 | Buchberger |
| 9,623,205 | B2 | 4/2017 | Buchberger |
| 2001/0042546 | A1 | 11/2001 | Umeda et al. |
| 2002/0016370 | A1 | 2/2002 | Shytle |
| 2002/0079309 | A1 | 6/2002 | Cox |
| 2003/0005620 | A1 | 1/2003 | Ananth et al. |
| 2003/0049025 | A1 | 3/2003 | Neumann |
| 2003/0079309 | A1 | 6/2003 | Cox |
| 2003/0106552 | A1 | 6/2003 | Sprinkel |
| 2003/0200964 | A1 | 10/2003 | Blakley |
| 2004/0031485 | A1 | 2/2004 | Rustad et al. |
| 2004/0129793 | A1 | 7/2004 | Nguyen et al. |
| 2005/0204799 | A1 | 9/2005 | Koch |
| 2005/0268911 | A1 | 12/2005 | Cross et al. |
| 2006/0078477 | A1 | 4/2006 | Althouse et al. |
| 2007/0014549 | A1 | 1/2007 | Demarest et al. |
| 2007/0062548 | A1 | 3/2007 | Horstmann |
| 2007/0102013 | A1 | 5/2007 | Adams |
| 2007/0107879 | A1 | 5/2007 | Radomski et al. |
| 2007/0155255 | A1 | 7/2007 | Galauner |
| 2008/0092912 | A1 | 4/2008 | Robinson |
| 2008/0216828 | A1 | 9/2008 | Wensley |
| 2008/0241255 | A1 | 10/2008 | Rose |
| 2009/0095311 | A1 | 4/2009 | Han |
| 2009/0272379 | A1 | 6/2009 | Thorens |
| 2009/0188490 | A1 | 7/2009 | Han |
| 2009/0293892 | A1 | 12/2009 | Williams |
| 2010/0059070 | A1 | 3/2010 | Potter et al. |
| 2010/0065653 | A1 | 3/2010 | Wingo et al. |
| 2010/0083959 | A1 | 4/2010 | Siller |
| 2010/0108059 | A1 | 5/2010 | Axelsson |
| 2010/0236546 | A1 | 9/2010 | Yamada |
| 2011/0011396 | A1 | 1/2011 | Fang |
| 2011/0126848 | A1 | 6/2011 | Zuber |
| 2011/0226236 | A1 | 9/2011 | Buchberger |
| 2011/0232654 | A1 | 9/2011 | Mass |
| 2011/0036363 | A1 | 12/2011 | Urtsev |
| 2011/0290267 | A1 | 12/2011 | Yamada |
| 2011/0297166 | A1 | 12/2011 | Takeuchi |
| 2011/0303231 | A1 | 12/2011 | Li |
| 2012/0006343 | A1* | 1/2012 | Renaud ..... A24B 15/12 131/280 |
| 2012/0145169 | A1 | 6/2012 | Wu |
| 2012/0260927 | A1 | 10/2012 | Qiuming |
| 2012/0279512 | A1 | 11/2012 | Hon |
| 2012/0285476 | A1 | 11/2012 | Hon |
| 2013/0074857 | A1 | 3/2013 | Buchberger |
| 2013/0081619 | A1 | 4/2013 | Seakins |
| 2013/0081623 | A1 | 4/2013 | Buchberger |
| 2013/0192615 | A1 | 8/2013 | Tucker |
| 2013/0213417 | A1 | 8/2013 | Chong |
| 2013/0213419 | A1 | 8/2013 | Tucker |
| 2013/0284192 | A1 | 10/2013 | Peleg |
| 2013/0333700 | A1 | 12/2013 | Buchberger |
| 2013/0340779 | A1 | 12/2013 | Liu |
| 2014/0000638 | A1 | 1/2014 | Sebastian |
| 2014/0007863 | A1 | 1/2014 | Zhiping |
| 2014/0060528 | A1 | 3/2014 | Liu |
| 2014/0060529 | A1* | 3/2014 | Zhang ..... A24D 47/008 128/202.21 |
| 2014/0060554 | A1 | 3/2014 | Collett |
| 2014/0060555 | A1 | 3/2014 | Chang |
| 2014/0202454 | A1 | 7/2014 | Buchberger |
| 2014/0209105 | A1 | 7/2014 | Sears |
| 2014/0238396 | A1 | 8/2014 | Buchberger |
| 2014/0238423 | A1 | 8/2014 | Tucker |
| 2014/0238424 | A1 | 8/2014 | Tucker |
| 2014/0261490 | A1 | 9/2014 | Kane |
| 2014/0270730 | A1 | 9/2014 | DePiano |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0338680 | A1 | 11/2014 | Abramov et al. |

(56) References Cited

U.S. PATENT DOCUMENTS

| | | | |
|---|---|---|---|
| 2015/0114411 | A1 | 4/2015 | Buchberger |
| 2015/0208728 | A1 | 7/2015 | Lord |
| 2016/0073693 | A1 | 3/2016 | Reevell |
| 2016/0106154 | A1 | 4/2016 | Lord |
| 2016/0106155 | A1 | 4/2016 | Reevell |
| 2016/0295923 | A1 | 10/2016 | Guangrong |
| 2017/0042245 | A1 | 2/2017 | Buchberger |
| 2017/0197043 | A1 | 7/2017 | Buchberger |
| 2017/0197044 | A1 | 7/2017 | Buchberger |
| 2017/0197046 | A1 | 7/2017 | Buchberger |

FOREIGN PATENT DOCUMENTS

| | | | |
|---|---|---|---|
| CA | 2309376 | | 11/2000 |
| CA | 2864238 | A1 | 8/2013 |
| CH | 698603 | B1 | 9/2009 |
| CN | 2092880 | | 1/1992 |
| CN | 2220168 | | 2/1996 |
| CN | 1205849 | A | 1/1999 |
| CN | 2719043 | | 8/2005 |
| CN | 201238609 | | 5/2009 |
| CN | 201375023 | | 1/2010 |
| CN | 101878958 | | 11/2010 |
| CN | 202172846 | | 3/2012 |
| CN | 102655773 | A | 9/2012 |
| CN | 202722498 | | 2/2013 |
| CN | 202750708 | | 2/2013 |
| CN | 103070472 | * | 5/2013 |
| CN | 203168033 | U | 9/2013 |
| CN | 103750573 | A | 4/2014 |
| CN | 106102863 | A | 11/2016 |
| DE | 1950439 | | 4/1971 |
| DE | 3148335 | | 7/1983 |
| DE | 3218760 | | 12/1983 |
| DE | 3936687 | | 5/1990 |
| DE | 19630619 | | 2/1998 |
| DE | 19654945 | | 3/1998 |
| DE | 10330681 | | 6/2004 |
| DE | 202006013439 | | 10/2006 |
| DE | 202013100606 | | 2/2013 |
| EP | 280262 | | 8/1988 |
| EP | 0295122 | | 12/1988 |
| EP | 0358002 | A2 | 3/1990 |
| EP | 0444553 | | 9/1991 |
| EP | 0845220 | | 6/1998 |
| EP | 0893071 | | 1/1999 |
| EP | 1166814 | | 1/2002 |
| EP | 1166847 | | 1/2002 |
| EP | 0488488 | | 3/2004 |
| EP | 1486226 | A2 | 12/2004 |
| EP | 1736065 | | 12/2006 |
| EP | 2018886 | | 1/2009 |
| EP | 2022349 | | 2/2009 |
| EP | 2113178 | | 11/2009 |
| EP | 2340729 | A1 | 7/2011 |
| EP | 2695531 | A1 | 2/2014 |
| EP | 2698070 | | 2/2014 |
| EP | 2762019 | | 8/2014 |
| EP | 2835062 | | 2/2015 |
| FR | 960469 | | 4/1950 |
| GB | 1313525 | | 4/1973 |
| GB | 25575 | | 11/2011 |
| GB | 2488257 | A | 8/2012 |
| HK | 1196511 | | 12/2014 |
| HK | 1226611 | | 10/2017 |
| JP | S57-052456 | | 3/1982 |
| JP | S59-106340 | | 1/1986 |
| JP | S61-096763 | | 5/1986 |
| JP | 61-096765 | | 1/1988 |
| JP | 2124081 | | 5/1990 |
| JP | H05103836 | A | 4/1993 |
| JP | H05-309136 | | 11/1993 |
| JP | H6315366 | | 11/1994 |
| JP | H08-299862 | | 11/1996 |
| JP | 11089551 | | 4/1999 |
| JP | 2002527153 | | 8/2002 |
| JP | 2004332069 | | 11/2004 |
| JP | 2005537918 | | 12/2005 |
| RU | 2311859 | C2 | 12/2007 |
| RU | 2336001 | C2 | 10/2008 |
| RU | 89927 | U1 | 12/2009 |
| RU | 94815 | U1 | 6/2010 |
| RU | 103281 | U1 | 4/2011 |
| RU | 115629 | U1 | 5/2012 |
| RU | 122000 | U1 | 11/2012 |
| RU | 124120 | | 1/2013 |
| WO | WO 1995/952712 | | 10/1995 |
| WO | WO 9527412 | | 10/1995 |
| WO | WO9632854 | | 10/1996 |
| WO | WO9748293 | A1 | 12/1997 |
| WO | WO200009188 | | 2/2000 |
| WO | WO0021598 | | 4/2000 |
| WO | WO2002058747 | | 8/2002 |
| WO | WO03028409 | | 4/2003 |
| WO | WO2003028409 | A1 | 4/2003 |
| WO | WO03050405 | | 6/2003 |
| WO | WO2003083283 | A1 | 10/2003 |
| WO | WO03101454 | | 12/2003 |
| WO | WO2004/022128 | | 3/2004 |
| WO | WO 2004/022242 | | 3/2004 |
| WO | WO2004022243 | | 3/2004 |
| WO | WO2004080216 | A1 | 9/2004 |
| WO | WO2005106350 | A2 | 11/2005 |
| WO | WO2006082571 | | 8/2006 |
| WO | WO2007042941 | | 4/2007 |
| WO | WO2007131449 | | 11/2007 |
| WO | WO2009015410 | | 2/2009 |
| WO | WO2009132793 | A1 | 11/2009 |
| WO | WO2010045670 | A1 | 4/2010 |
| WO | WO2010045671 | A1 | 4/2010 |
| WO | WO2011109849 | A1 | 9/2011 |
| WO | WO2011137453 | A2 | 11/2011 |
| WO | WO2012025496 | A1 | 3/2012 |
| WO | WO2013034453 | A1 | 3/2013 |
| WO | WO2013034460 | A1 | 3/2013 |
| WO | WO2013057185 | A1 | 4/2013 |
| WO | WO2013060784 | A2 | 5/2013 |
| WO | WO 2013/082173 | | 6/2013 |
| WO | WO2013098395 | A1 | 7/2013 |
| WO | WO2013116558 | | 8/2013 |
| WO | WO2014130695 | | 8/2013 |
| WO | WO2013149404 | A1 | 10/2013 |
| WO | WO2014061477 | A1 | 4/2014 |
| WO | WO2014140320 | A1 | 9/2014 |
| WO | WO2014150131 | A1 | 9/2014 |
| WO | WO2015117702 | A1 | 8/2015 |
| WO | WO2017055866 | | 4/2017 |

OTHER PUBLICATIONS

Japanese Search Report, Application No. 2017-504040, dated Jan. 15, 2018, 8 pages (15 pages with translation).

Chinese Office Action, Application No. 201580040255.3, dated Aug. 24, 2018, 8 pages.

International Preliminary Report on Patentability for corresponding International Application No. PCT/GB2015/051213 dated Jul. 14, 2016.

International Search Report for corresponding International Application No. PCT/GB2015/051213 dated Jul. 16, 2015.

Written Opinion of the International Preliminary Examining Authority for International Application No. PCT/GB2015/051213 dated Mar. 29, 2016.

International Search Report and Written Opinion dated Feb. 6, 2013 for PCT/EP0212/070647 filed Oct. 18, 2012.

Chinese Office Action for Chinese Application No. 201480024978.X dated Jan. 18, 2017.

European Search Report for European Application No. 15178588 dated Apr. 14, 2016.

International Preliminary Report on Patentability, dated Apr. 22, 2014, for International Patent Application No. PCT/EP2012/070647, filed Oct 18, 2012.

(56) References Cited

OTHER PUBLICATIONS

International Search Report and Written Opinion for International Application No. PCT/EP2012/003103, dated Nov. 26, 2012.
International Search Report and Written Opinion for PCT/AT/2012/000017 dated Jul. 3, 2012.
International Search Report and Written Opinion for PCT/GB2014/051333 dated Jul. 17, 2014.
International Search Report and Written Opinion, International Application No. PCT/GB2014/051332 dated Jul. 21, 2014.
International Search Report and Written Opinion, International Application No. PCT/GB2014/051334 dated Jul. 21, 2014.
IPRP mailed Aug. 5, 2015 for International Application No. PCT/GB2014/051333.
IPRP, International Application No. PCT/GB2014/051332 mailed Nov. 12, 2015.
IPRP, International Application No. PCT/GB2014/051334 mailed Nov. 12, 2015.
Japanese Notice of Reasons for Rejection for Japanese Application No. 2015-137361 dated May 31, 2016.
Russian Search Report for Russian Application No. 2015146843/12 (072088) date completed Apr. 24, 2017.
Russian Office Action, Application No. 2014120213/12, dated Oct. 26, 2016, 7 pages.
Russian Office Action, Application No. 2014120213/12, dated Sep. 22, 2017, 11 pages.
Chinese Office Action, Application No. 201480024988.3, dated Dec. 30, 2016, 26 pages.
Chinese Office Action, Application No. 201480024988.3, dated Sep. 11, 2017, 21 pages.
European Extended Search Report, Application No. 17189951.1, dated Jan. 4, 2018, 8 pages (11 pages with translation).
Plasma polymerization (the company Diener electronic GmbH+Co. KG), www.plasma.de, retrieved on Oct. 17, 2017, 19 pages.
International Preliminary Report on Patentability (WIPO English Translation), dated Aug. 13, 2013 for International Patent Application No. PCT/AT2012/000017, filed Feb. 2, 2012.
Pulmonary Pharmacology: Delivery Devices and Medications, dated Sep. 6, 2017, 2 pages, available at www.cdeu.org/cecourses/z98207/ch4.htm.
International Search Report for International Application No. PCT/AT2009/000413 dated Jan. 25, 2010.
Chinese First Office Action for Chinese Application No. 200980152395.4 dated Dec. 3, 2012.
Translation of Chinese Second Office Action for Chinese Application No. 200980152395.4 dated Aug. 20, 2013.
European Examination Report, Application No. 15741289.1, dated Jun. 15, 2018, 6 pages.
Korean Office Action, Application No. 2017-7002235, dated Mar. 15, 2018, 14 pages.
Japanese Office Action, Application No. 2017-504040, dated Feb. 22, 2018, 7 pages.
Canadian Office Action, Application No. 2,954,848, dated Dec. 18, 2017, 4 pages.
Kynol, Standard Specifications of Kynol Activated Carbon Fiber Products, published by Kynol. 2003. 2 pages.
International Search Report dated Jan. 26, 2010 for International Application No. PCT/AT2009/000414.
Japanese Notice of Reasons for Rejection dated Sep. 8, 2015 for Japanese Application No. 2014179732. English translation provided.
Japanese Notice of Reasons for Rejection dated Oct. 15, 2013 for Japanese Application No. 2011532464. English translation provided.
Japanese Office Action, for Application No. 2016-134648, dated May 23, 2017, 18 pages.
Dunn et al., "Heat Pipes". Fourth Edition. Pergamon. (1994) 14 pages. ISBN 0080419038.
European Search Report for European Application No. 16166656 dated Oct. 11, 2016.
Notice of Opposition Letter from EPO. Opposition against: EP2358418 dated Mar. 1, 2017.
Rudolph G, BAT Cigarettenfabriken GmbH, 1987, The Influence of CO2 on the Sensory Characteristics of the Favor-System, http://legacy.library.ucsf.edu/tid/sla51f00.
Japanese Office Action, Application No. 2017-504040, dated Oct. 9, 2018, 2 pages (5 pages with translation).

* cited by examiner

AEROSOL PROVISION SYSTEM

CROSS-REFERENCE TO RELATED APPLICATIONS

The present application is a National Phase entry of PCT Application No. PCT/GB2015/052084, filed Jul. 17, 2015, which claims priority from GB Patent Application No. 1413259.1, filed Jul. 25, 2014, each of which is hereby fully incorporated herein by reference.

TECHNICAL FIELD

The present disclosure relates to aerosol provision systems such as nicotine delivery systems (e.g. e-cigarettes).

BACKGROUND

Aerosol provision systems such as e-cigarettes generally contain a reservoir of a source liquid containing a formulation, typically including nicotine, for which an aerosol is generated, e.g. through vaporization or other means. Thus an aerosol source for an aerosol provision system may comprise a heater coupled to a portion of the source liquid from the reservoir. When a user inhales on the device, the heater is activated to vaporize a small amount of the source liquid, which is thus converted to an aerosol for inhalation by the user. More particularly, such devices are usually provided with one or more air inlet holes located away from a mouthpiece of the system. When a user sucks on the mouthpiece, air is drawn in through the inlet holes and past the aerosol source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

Typically, aerosol provision systems such e-cigarettes contain an aerosol generating component, such as a heater. The liquid source is generally arranged within the system such that it can access the aerosol generating component. For example, it may be that the aerosol generating component is a wire which is heated during use of the device. As a result of the contact between the liquid formulation and the wire, when the wire is hearted during use the liquid formulation is vaporized and subsequently condenses into an aerosol which is then inhaled by the user. The means by which the liquid formulation can contact the wire may vary. It is not uncommon for the liquid source to be stored in a wadding or other type of holding matrix. This wadding or matrix then either itself directly contacts the heating wire, or alternatively it may be that a further "wick" is in contact with both the wadding and the heating wire. This wick serves to draw the liquid formulation from the wadding to the heating wire during use.

Other types of systems do not employ wadding to hold the liquid formulation. Instead, in these systems the liquid formulation is held freely in a tank or other storage area and is directly fed to the heating wire (which may itself include a wicking core to assist in holding the liquid formulation in proximity to the wire). Such "direct flow" systems may have disadvantages associated with leakage. Other systems which may be less prone to leakage include the liquid formulation held freely in a tank or other storage area, but include means to prevent the "direct flow" of the liquid formulation to the heating wire. However, it has been found that the above systems employing the "free" storage of the liquid formulation may lead to the generation of aerosols with certain degradation products.

Accordingly there remains a need for aerosol provision systems which seek to ameliorate some of the issues discussed above.

SUMMARY

The disclosure relates to an aerosol provision system comprising a liquid storage area comprising a liquid formulation; an aerosol generating area; a membrane disposed between the liquid storage area and the aerosol generating area, said membrane fluidly communicating the liquid storage area with the aerosol generating area; wherein the liquid formulation has a water content of at least 18% w/w.

It has surprisingly been found that systems according to the present disclosure produce aerosols with relatively lower amounts of some degradation products compared to previously known systems. Additionally, the systems of the present disclosure did not suffer from the leakage problems associated with the previously known systems.

The approach described herein is not restricted to specific embodiments such as set out below, but includes and contemplates any appropriate combinations of features presented herein. For example, an electronic aerosol provision system may be provided in accordance with the approach described herein which includes any one or more of the various features described below as appropriate.

BRIEF DESCRIPTION OF THE DRAWINGS

Various embodiments will now be described in detail by way of example only with reference to the following drawings.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to an aerosol provision system, such as an e-cigarette. Throughout the following description the term "e-cigarette" is sometimes used; however, this term may be used interchangeably with aerosol (vapor) provision system, or vapor provision device.

Figure 1:
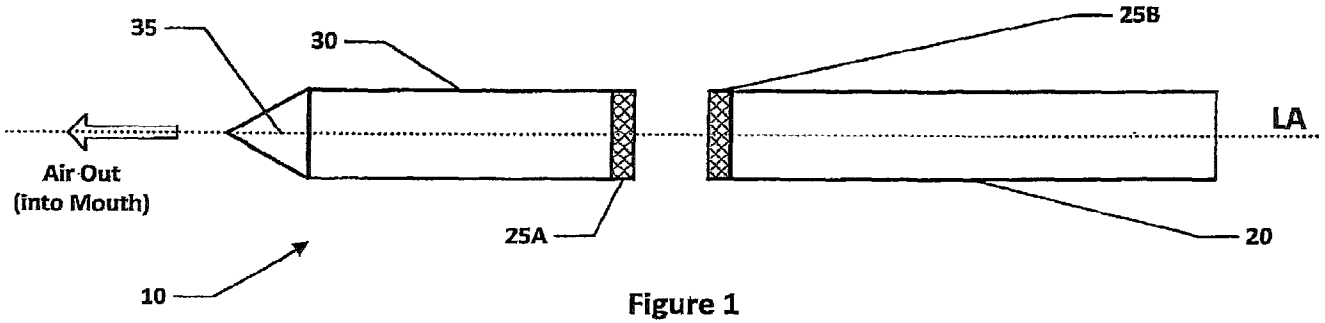
FIG. 1 is a schematic (exploded) diagram of an aerosol provision system such as an e-cigarette in accordance with some embodiments.

FIG. 1 is a schematic diagram of an aerosol/vapor provision system such as an e-cigarette 10 in accordance with some embodiments (not to scale). The e-cigarette has a generally cylindrical shape, extending along a longitudinal axis indicated by dashed line LA, and comprises two main components, namely a body 20 and a cartomizer 30. The cartomizer 30 includes an internal chamber containing a liquid storage area comprising a liquid formulation from which an aerosol is to be generated, for example containing nicotine, and an aerosol generator. The liquid formulation and the aerosol generator may be collectively referred to as an aerosol source. The cartomizer 30 further includes a mouthpiece 35 having an opening through which a user may inhale the aerosol generated by the aerosol source. The storage area for the liquid formulation may comprise a foam matrix or any other structure, such as a wadding, within a housing for retaining the liquid formulation until such time that it is required to be delivered to the aerosol generator/vaporizer. The aerosol generator includes a heater for vaporizing the liquid formulation to form the aerosol. The aerosol generator may further include a wick or similar facility to transport a small amount of the liquid formulation from the storage area to a heating location on or adjacent the heater.

The body 20 includes a re-chargeable cell or battery to provide power for the e-cigarette 10 and a circuit board for generally controlling the e-cigarette 10. In use, when the heater receives power from the battery, as controlled by the circuit board, the heater vaporizes the liquids formulation at the heating location to generate the aerosol, and this is then inhaled by a user through the opening in the mouthpiece 35. The aerosol is carried from the aerosol source to the mouthpiece 35 along an air channel that connects the aerosol source to the mouthpiece opening as a user inhales on the mouthpiece 35.

In this particular example, the body 20 and cartomizer 30 are detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the body 20 and the cartomizer 30. The electrical connector on the body 20 that is used to connect to the cartomizer 30 also serves as a socket for connecting a charging device (not shown) when the body is detached from the cartomizer 30. The other end of the charging device can be plugged into an external power supply, for example a USB socket, to charge or to re-charge the cell/battery in the body 20 of the e-cigarette 10. In other implementations, a cable may be provided for direct connection between the electrical connector on the body 20 and the external power supply.

The e-cigarette 10 is provided with one or more holes (not shown in FIG. 1) for air inlet. These holes connect to an air running passage through the e-cigarette 10 to the mouthpiece 35. The air passage includes a region around the aerosol source and a section comprising an air channel connecting from the aerosol source to the opening in the mouthpiece 35.

When a user inhales through the mouthpiece 35, air is drawn into this air passage through the one or more air inlet holes, which are suitably located on the outside of the e-cigarette 10. This airflow (or the resulting change in pressure) is detected by a pressure sensor that in turn activates the heater to vaporize a portion of the liquid formulation to generate the aerosol. The airflow passes through the air passage, and combines with, the aerosol in the region around the aerosol source, and the resulting combination of airflow and aerosol then travel along the air channel connecting from the aerosol source to the mouthpiece 35 to be inhaled by a user. The cartomizer 30 may be detached from the body 20 and disposed of when the supply of liquid formulation is exhausted (and replaced with another cartomizer if so desired). Alternatively, the cartomizer 30 maybe refillable.

It will be appreciated the e-cigarette 10 shown in FIG. 1 is presented by way of example, and various other implementations can be adopted. For example, in some embodiments, the cartomizer 30 is provided as two separable components, namely a cartridge comprising the liquid storage area and mouthpiece (which can be replaced when the liquid from the reservoir is exhausted), and a vaporizer/aerosol generator comprising a heater (which is generally retained). As another example, the charging facility may connect to an additional or alternative power source, such as a car cigarette lighter socket.

Figure 2:
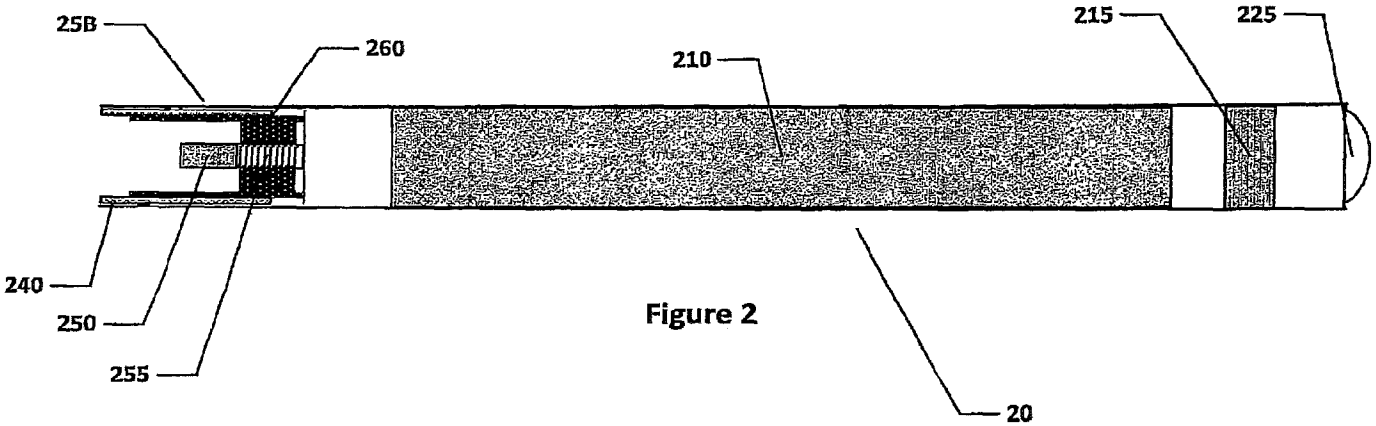
FIG. 2 is a schematic diagram of a main body portion of the e-cigarette of FIG. 1 in accordance with some embodiments.

FIG. 2 is a schematic (simplified) diagram of the body 20 of the e-cigarette 10 of FIG. 1. FIG. 2 can generally be regarded as a cross-section in a plane through the longitudinal axis LA of the e-cigarette 10. Note that various components and details of the body 20, e.g. such as wiring and more complex shaping, have been omitted from FIG. 2 for reasons of clarity.

As shown in FIG. 2, the body 20 includes a battery or cell 210 for powering the e-cigarette 10, as well as a chip, such as an application specific integrated circuit (ASIC) or microcontroller for controlling the e-cigarette 10. The ASIC may be positioned alongside or at one end of the battery 210. The ASIC is attached to a sensor unit 215 to detect an inhalation on mouthpiece 35 (or alternatively the sensor unit 215 may be provided on the ASIC itself). In response to such a detection, the ASIC provides power from the battery 210 or cell 210 to the heater in the cartomizer 30 to vaporize source liquid and introduce an aerosol into the airflow which is inhaled by a user. It should be noted that the precise positioning of the ASIC/sensor within the body 20 is not strictly limited.

The body further includes a cap 225 to seal and protect the far (distal) end of the e-cigarette 10. There is an air inlet hole provided in or adjacent to the cap 225 to allow air to enter the body 20 and flow past the sensor unit 215 when a user inhales on the mouthpiece 35. This airflow therefore allows the sensor unit 215 to detect the user inhalation and so activate the aerosol generator element of the e-cigarette 10.

At the opposite end of the body 20 from the cap 225 is the connector 25B for joining the body 20 to the cartomizer 30. The connector 25B provides mechanical and electrical connectivity between the body 20 and the cartomizer 30. The connector 25B includes a body connector 240, which is metallic (silver-plated in some embodiments) to serve as one terminal for electrical connection (positive or negative) to the cartomizer 30. The connector 25B further includes an electrical contact 250 to provide a second terminal for electrical connection to the cartomizer 30 of opposite polarity to the first terminal, namely body connector 240. The electrical contact 250 is mounted on a coil spring 255. When the body 20 is attached to the cartomizer 30, the connector 25A on the cartomizer 30 pushes against the electrical contact 250 in such a manner as to compress the coil spring in an axial direction, i.e. in a direction parallel to (co-aligned with) the longitudinal axis LA. In view of the resilient nature of the spring 255, this compression biases the spring 255 to expand, which has the effect of pushing the electrical contact 250 firmly against connector 25A, thereby helping to ensure good electrical connectivity between the body 20 and the cartomizer 30. The body connector 240 and the electrical contact 250 are separated by a trestle 260, which is made of a non-conductor (such as plastic) to provide good insulation between the two electrical terminals. The trestle 260 is shaped to assist with the mutual mechanical engagement of connectors 25A and 25B. It may be that when the sensor 215 is located at the opposite end of the body 20 relative to the cap 225, the body 20 includes one or more air inlet holes provided in or adjacent to connector 25B to allow air to enter the body 20 and flow past the sensor unit 215 when a user inhales on the mouthpiece 35.

Figure 3:
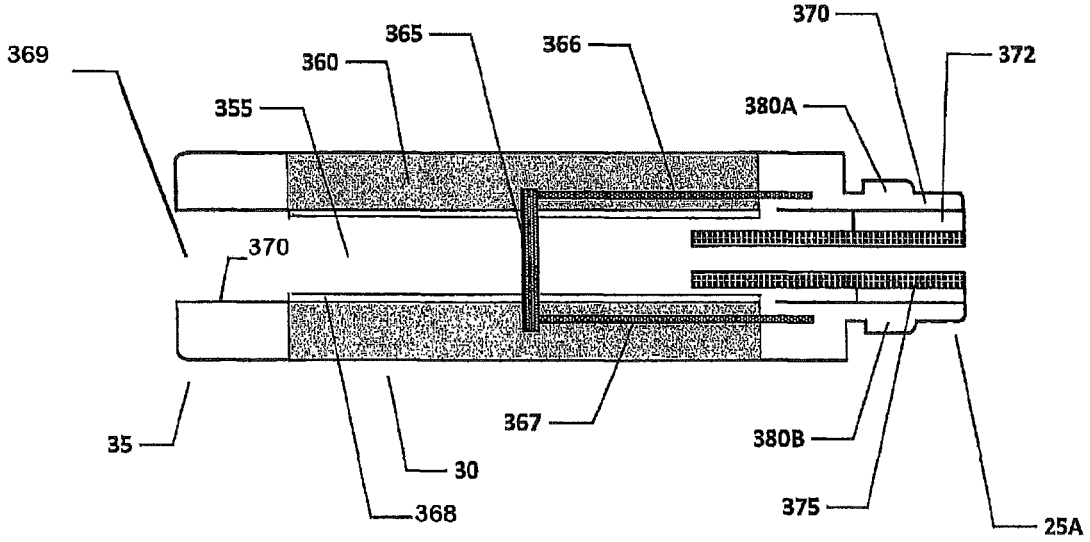
FIG. 3 is a schematic diagram of an aerosol source portion of the e-cigarette of FIG. 1 in accordance with some embodiments.

FIG. 3 is a schematic diagram of the cartomizer 30 of the e-cigarette 10 of FIG. 1 in accordance with some embodiments. FIG. 3 can generally be regarded as a cross-section in a plane through the longitudinal axis LA of the e-cigarette 10. Note that various components and details of the body 20, e.g. such as wiring and more complex shaping, have been omitted from FIG. 3 for reasons of clarity.

The cartomizer 30 includes an air passage 355 extending along the central (longitudinal) axis of the cartomizer 30 from the mouthpiece 35 to the connector 25A for joining the cartomizer 30 to the body 20.

A liquid storage area 360 is provided around the air passage 335. This storage area 360 may be implemented, for example, by providing cotton or foam soaked in source liquid. The cartomizer 30 also includes a heater 365 for heating liquid from the storage area 360 to generate an aerosol to flow through air passage 355 and out through an opening 369 in the mouthpiece 35 in response to a user inhaling on the e-cigarette 10. The heater 365 is powered through lines 366 and 367, which are in turn connected to opposing polarities (positive and negative, or vice versa) of the battery 210 via connector 25A (the details of the wiring between the power lines 366 and 367 and connector 25A are omitted from FIG. 3).

The connector 25A includes an inner electrode 375, which may be silver-plated or made of some other suitable metal. When the cartomizer 30 is connected to the body 20, the inner electrode 375 contacts the electrical contact 250 of the body 20 to provide a first electrical path between the cartomizer 30 and the body 20. In particular, as the connectors 25A and 25B are engaged, the inner electrode 375 pushes against the electrical contact 250 so as to compress the coil spring 255, thereby helping to ensure good electrical contact between the inner electrode 375 and the electrical contact 250.

The inner electrode 375 is surrounded by an insulating ring 372, which may be made of plastic, rubber, silicone, or any other suitable material. The insulating ring 372 is surrounded by the cartomizer connector 370, which may be silver-plated or made of some other suitable metal or conducting material. When the cartomizer 30 is connected to the body 20, the cartomizer connector 370 contacts the body connector 240 of the body 20 to provide a second electrical path between the cartomizer 30 and the body 20. In other words, the inner electrode 375 and the cartomizer connector 370 serve as positive and negative terminals (or vice versa) for supplying power from the battery 210 in the body 20 to the heater 365 in the cartomizer 30 via supply lines 366 and 367 as appropriate.

The cartomizer connector 370 is provided with two lugs or tabs 380A, 380B, which extend in opposite directions away from the longitudinal axis of the e-cigarette 10. These tabs are used to provide a bayonet fitting in conjunction with the body connector 240 for connecting the cartomizer 30 to the body 20. This bayonet fitting provides a secure and robust connection between the cartomizer 30 and the body 20, so that the cartomizer 30 and body 20 are held in a fixed position relative to one another, without wobble or flexing, and the likelihood of any accidental disconnection is very small. At the same time, the bayonet fitting provides simple and rapid connection and disconnection by an insertion followed by a rotation for connection, and a rotation (in the reverse direction) followed by withdrawal for disconnection. It will be appreciated that other embodiments may use a different form of connection between the body 20 and the cartomizer 30, such as a snap fit or a screw connection.

Figure 4:
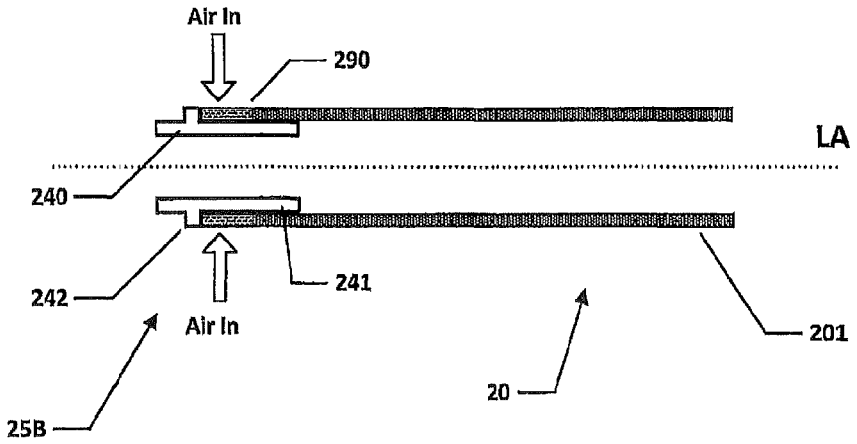
FIG. 4 is a schematic diagram showing certain aspects of one end of the main body portion of the e-cigarette of FIG. 1 in accordance with some embodiments.

FIG. 4 is a schematic diagram of certain details of the connector 25B at the end of the body 20 in accordance with some embodiments (but omitting for clarity most of the internal structure of the connector 25B as shown in FIG. 2, such as trestle 260). In particular, FIG. 4 shows the external housing 201 of the body 20, which generally has the form of a cylindrical tube. This external housing 201 may comprise, for example, an inner tube of metal with an outer covering of paper or similar.

The body connector 240 extends from this external housing 201 of the body 20. The body connector 240 as shown in FIG. 4 comprises two main portions, a shaft portion 241 in the shape of a hollow cylindrical tube, which is sized to fit just inside the external housing 201 of the body 20, and a lip portion 242 which is directed in a radially outward direction, away from the main longitudinal axis (LA) of the e-cigarette 10. Surrounding the shaft portion 241 of the body connector 240, where the shaft portion 241 does not overlap with the external housing 201, is a collar or sleeve 290, which is again in a shape of a cylindrical tube. The collar 290 is retained between the lip portion 242 of the body connector 240 and the external housing 201 of the body 20, which together prevent movement of the collar 290 in an axial direction (i.e. parallel to axis LA). However, collar 290 is free to rotate around the shaft portion 241 (and hence also axis LA).

As mentioned above, the cap 225 is provided with an air inlet hole to allow air to flow past sensor 215 when a user inhales on the mouthpiece 35. However, the majority of air that enters the device 10 when a user inhales flows through collar 290 and body connector 240 as indicated by the two arrows in FIG. 4.

Figure 5A:
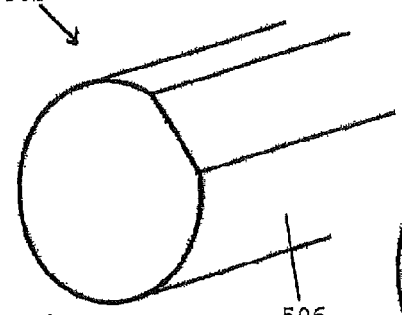
FIGS. 5A to 5E are schematic diagrams of components of an aerosol provision system in accordance with some other embodiments.
Figure 5B:
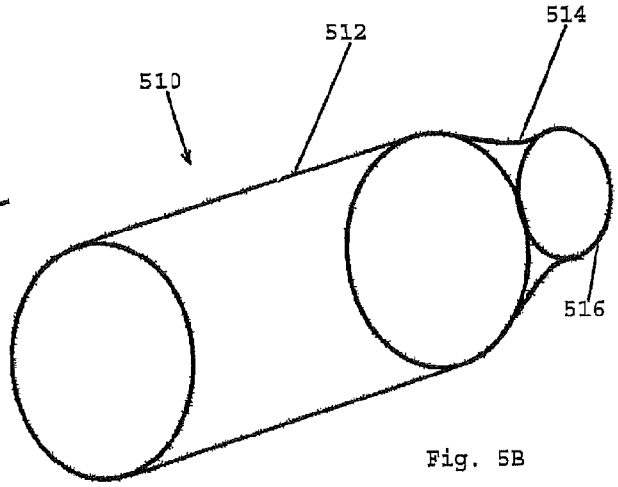
Figure 5C:
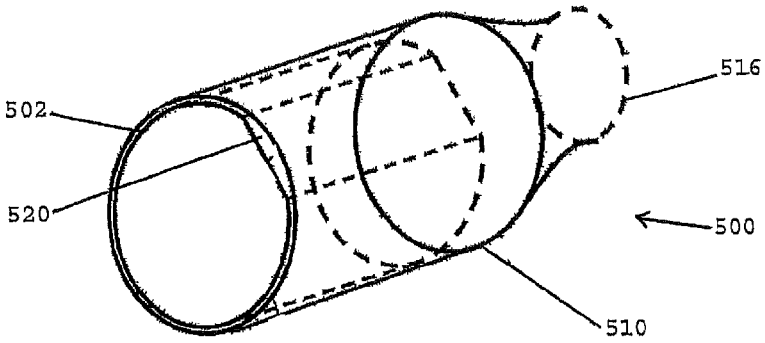

FIGS. 5A to 5E schematically represent in perspective view some aspects of part an aerosol provision system 500 according to some other embodiments. In particular, FIG. 5A schematically represents a first component comprising a liquid storage area component 502 and FIG. 5B schematically represents a second component 510 comprising part of a housing for the aerosol provision system 500. These two components of the aerosol provision system 500 are shown separately in FIGS. 5A and 5B for ease of representation, whereas in normal use these two components are assembled together as schematically represented in FIG. 5C. In the assembled state for this particular design of aerosol provision system, the liquid storage area component 502 is fitted inside the housing component 510. It will be appreciated the aerosol provision system 500 will in general comprise various other features, for example a power supply, which are not shown in FIGS. 5A to 5E for simplicity. Such other features of the aerosol provision system may be provided in accordance with conventional techniques. More generally, it will be appreciated that aspects and features of aerosol provision systems described herein may be implemented in accordance with any established techniques apart from where modified in accordance with the embodiments described herein.

The liquid storage component 502 comprises a liquid storage body 506 defining a liquid storage area. The liquid storage area comprises a liquid formulation from which an aerosol is to be generated. The base of the liquid storage component is open and cooperates with membrane 601 and optionally also liquid distributing component 602. Thus, it will be appreciated that both membrane 601 and component 602 may be dimensioned to be received within the opening of the liquid storage component 502, and they may further form an interference fit with the inner wall of the liquid storage component 502.

The membrane 601 is positioned between the liquid storage area and an aerosol generating area of the system (not shown in FIG. 5). The membrane 601 allows for the liquid formulation contained in the liquid storage area to be fluidly communicated to the aerosol generating area of the system.

In this regard, the presence of the membrane typically results in a reduced "flow" of liquid compared to the "direct flow" that is seen in other systems of the prior art not employing such a membrane 601. The particular construction of the membrane 601 need not be particularly limited, provided that it allows for the liquid formulation contained within the liquid store to be transferred to the aerosol generating area. It is also generally preferred if the membrane 601 has a degree of heat resistance. In one embodiment, the membrane 601 is a formed from a porous material. In one embodiment, the membrane 601 is formed from a porous ceramic material. In one embodiment, the membrane 601 is formed from ceramic fibers. In this regard, ceramic fibers are known to be heat resistant and yet also provide a degree of porosity owing to their structure. Ceramic fibers may also be known as "high-temperature insulation wool" (HTIW). High-temperature insulation wool is an accumulation of fibers of different lengths and diameters, produced synthetically from mineral raw materials. The raw mineral materials are typically melted and then processed into fibers which are then formed into the final material. Different types of HTIW may be available, such as alkaline earth silicate wool, alumina silicate wool, and poly-silicate wool. Alumino silicate wool, also known as "refractory ceramic fiber" (RCF), are amorphous fibers produced by melting a combination of $Al_2O_3$ and $SiO_2$, usually in a weight ratio of about 50:50. In one embodiment, the membrane 601 is formed from an alumina silicate wool. In one embodiment, the alumina silicate wool has a $Al_2O_3$ content of from 48 to 54% and a $SiO_2$ content of from 46 to 52%. Other raw materials, such as $Fe_2O_3$ may also be present in minor amounts. The skilled person is aware of the various considerations for producing high temperature insulation wool. In this regard, a suitable high temperature insulation wool may be obtained from Zibo Dingrong High-Temperature Materials Co., Ltd, Zibo City, Shandong Province, China.

The dimensions of the membrane 601 itself are not particularly limited. Typically, the thickness of the membrane 601 may be in the range 0.1 mm to 2 mm. In one embodiment, the thickness of the membrane 601 may be in the range 0.1 to 1 mm. In one embodiment, the thickness of the membrane 601 may be in the range 0.5 to 1.5 mm. In one embodiment, the thickness of the membrane 601 may be in the range 0.5 to 1 mm.

Figure 5D:
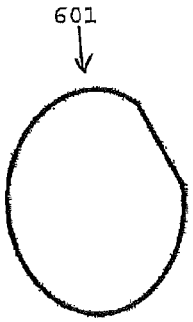
Figure 5E:
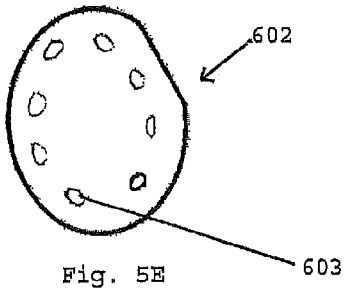

The shape of the membrane 601 may not be particularly limited. Typically, the membrane 601 has a shape which conforms to the general cross-sectional shape of the liquid storage area. For example, as shown in FIG. 5D, the membrane 601 has a shape which corresponds to the cross-sectional profile of the liquid storage area of liquid storage component 502. Such a shape helps to ensure that an interference/friction fit can be established with the inner walls of the liquid storage component 502. The membrane 601 is generally planar.

However, it may in some circumstances be non-planar where such a configuration is necessary. For example, it may be that the membrane 601 is tubular with the liquid formulation being stored in a storage area radially outward of the membrane, with the aerosol generating area, including aerosol generating component, being disposed radially inwardly of the tubular membrane.

The aerosol generating area comprises an aerosol generating component, such as a heater. In some embodiments, the heater takes the form of a wire 701, which may also be coiled. The coiled wire may have a wick 801 running through the longitudinal axis formed by the turns of the coil. This wick 801 may then contact the membrane at point "C" shown for example in FIG. 6 so as to draw liquid from the membrane 601 onto or near the wire 701.

Whilst the membrane 601 has the advantage of sealing the liquid storage area of the liquid storage component 502, thus ameliorating issues relating to leakage of any liquid formulation, it has been noticed that previous systems utilizing such a membrane 601 may give rise to relatively increased degradation products. In an attempt to ameliorate this issue, the system of the present disclosure utilizes a liquid formulation comprising a defined water content. Without being bound by theory, it is thought that this water content may lead to the formulation being able to traverse the membrane 601 more easily. In turn, this results in a more consistent supply of liquid formulation to the aerosol generating area. By providing a more consistent supply of liquid formulation to the aerosol generating area it is possible to suppress any over-heating of the heater which may otherwise occur because the liquid is not present in sufficient amounts to suppress its temperature. This in turn appears to have led to less degradation products being generated. It has also been found that such systems comprising such liquid formulations are less susceptible to leakage than those using a "direct flow" system.

The liquid formulation has a water content of at least about 18% w/w. In one embodiment, the liquid formulation has a water content of at least 19% w/w. In one embodiment, the liquid formulation has a water content of at least 20% w/w. In one embodiment, the liquid formulation has a water content of at least 21% w/w. In one embodiment, the liquid formulation has a water content of at least 22% w/w. In one embodiment, the liquid formulation has a water content of at least 23% w/w. In one embodiment, the liquid formulation has a water content of from 18% w/w up to about 50% w/w. In one embodiment, the liquid formulation has a water content of from 19% w/w up to about 50% w/w. In one embodiment, the liquid formulation has a water content of from 20% w/w up to about 50% w/w. In one embodiment, the liquid formulation has a water content of from 21% w/w up to about 50% w/w. In one embodiment, the liquid formulation has a water content of from 22% w/w up to about 50% w/w. In one embodiment, the liquid formulation has a water content of from 23% w/w up to about 50% w/w. In one embodiment, the liquid formulation has a water content of from 24% w/w up to about 50% w/w. In one embodiment, the liquid formulation has a water content of from 18% w/w up to about 45% w/w. In one embodiment, the liquid formulation has a water content of from 18% w/w up to about 40% w/w. In one embodiment, the liquid formulation has a water content of from 18% w/w up to about 35% w/w. In one embodiment, the liquid formulation has a water content of from about 20% w/w up to about 30% w/w. In one embodiment, the liquid formulation has a water content of from about 22% w/w up to about 27% w/w. In one embodiment, the liquid formulation has a water content of about 25% w/w.

The liquid formulation may comprise a number of other components selected from glycerol, propylene glycol (PG), nicotine, and flavorings. The amounts of these components can generally be varied depending on the desired profile of the formulation. Typically, however, the liquid formulation may comprise 40 to 60% w/w glycerol, 20 to 35% w/w propylene glycol, 0 to 3% w/w nicotine, and 0 to 5% w/w flavorings. In some embodiments, the flavorings are dissolved in the PG and so the "flavoring" component may be understood as a combination of the PG and the active flavoring compounds. Typical flavoring components may include menthol, and other active compounds providing other sensory flavors such as cherry, smokey, etc.

Figure 6:
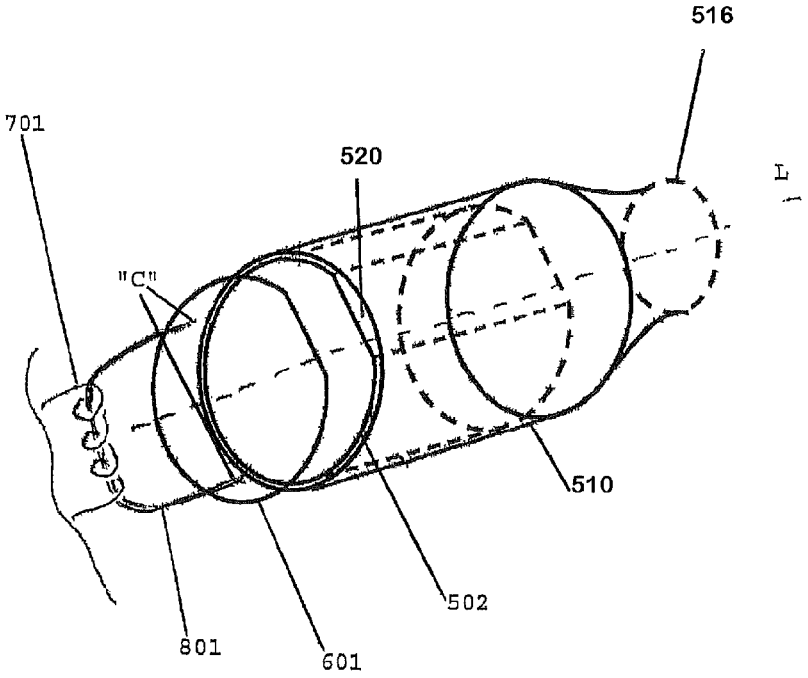
FIG. 6 is an exploded, schematic diagram showing various components of an aerosol provision system in accordance with some other embodiments.

As discussed above, a liquid distribution component 602 may optionally be present in the system between the membrane 601 and the liquid storage area. The liquid distribution component 602 may have the function of providing more controlled wetting of the membrane 601. Thus, the component 602 has one or more through holes 603 which allow for the liquid formulation to flow from the liquid storage area onto the membrane 601. The membrane 601 and the liquid distribution component 602 may generally be disposed such that their central point is in-line with the central longitudinal axis of the system. In this regard, such a configuration (showing the membrane only) is shown in FIG. 6. The general configuration of the liquid distribution component 602 (if present) may be similar to that of the membrane 601. Thus it may have a corresponding cross-sectional profile and be generally planar.

The reservoir body 506 is generally in the form of a circular cylinder with a flat face 508 running longitudinally along one side. The reservoir body 506 may be formed in accordance with conventional techniques, for example comprising a molded plastics material.

The housing component 510 is generally tubular and circularly symmetric. The housing component 510 comprises a main housing component 512 and a mouthpiece component 514. These may be formed separately or integrally. The main housing component 512 and mouthpiece component 514 may be formed in accordance with conventional techniques, for example comprising extruded aluminum or molded plastic. The main housing component 512 comprises a generally cylindrical tube having an interior dimension conforming to the exterior dimension of the liquid storage component 502. Thus the liquid storage component 502 can be received within the housing component 510 in a close-fitting arrangement, as schematically represented in FIG. 5C. It will be appreciated the housing component 510 will in general extend further than represented in FIG. 5C so as to generally enclose the aerosol generator 504. The mouthpiece component 514 of the housing component 510 is contoured to provide a transition from the shape of the main housing component to a shape which is ergonomically suited to be received by a user's lips during use. The mouthpiece component 514 includes an opening 516 at the end through which a user may inhale aerosol generated by the aerosol source.

As can be seen from the schematic representation in FIG. 5C, when the liquid storage component 502 is inserted into the housing component 510, the provision of the flat surface 508 creates a spacing between the outside wall of the reservoir body 506 and the inside wall of the housing component 510. This region where the first component 502 and the second component 510 of the aerosol provision system 500 are spaced apart thereby defines part of an air channel 520 connecting from the vicinity of the aerosol generator 504 to the opening 516. Other parts of the air channel are defined by the interior of the housing 510 that does not surround the liquid storage component 502 adjacent to the mouthpiece 514 and the interior surface of the mouthpiece 514. In general there may be further structural elements of the aerosol provision system in these regions to define the air channel 520. For example, flow restrictors and/or baffles and/or switchbacks may be provided to govern the airflow in accordance with conventional techniques.

As discussed briefly above, FIG. 6 shows an exploded view of the aerosol provision system 500 and also indicates the presence of a heating wire 701 as the aerosol generating component, and a wick 801 that extends through the wire (which in this configuration is coiled). The wire 701 and wick 801 sit in a housing of the aerosol generating area (not shown). The wire 701 is electrically connected through (optionally via/through the housing of the aerosol generating area) to a power source in the body 20 of the system. As will be apparent from FIG. 6, liquid formulation is stored with the liquid storage area formed within the liquid storage component 502. The membrane 601 then separates the liquid storage area (and thus the liquid formulation) from the aerosol generating area containing the wire 701 and the wick 801. The membrane 601 serves as a barrier to the "free flow" of liquid formulation into the aerosol generating area. However, the membrane 601 is configured to fluidly communicate the liquid storage area with the aerosol generating area. In other words, the liquid formulation is able to travel across the membrane 601 from one side to the other. Wick 801 is typically in contact with the underside of the membrane 601 and thus serves to draw the liquid formulation that has traveled across the membrane 601 towards the heating wire 701. The wick 801 itself can be made of any suitable material known in the art which has a high degree of heat resistance and is capable of transporting a liquid, e.g. through capillary action. In one embodiment, the wick 801 is secured to the underside of the membrane 601. This may be achieved through the use of an adhesive, or through physical means (such as a clamp etc.). Such an arrangement ensures good contact with the underside of the membrane 601. Points "C" shown in FIG. 6 illustrate points of contact between the wick 801 and the underside of the membrane 601.

The general operating principles of the aerosol provision system 500 schematically represented in FIGS. 5A to 5E and FIG. 6 may be similar to those described above for the aerosol provision system represented in FIGS. 1 to 4. Thus, in use, a user sucks on the mouthpiece 514, which leads to air being drawn into the interior of the aerosol provision system 500 through inlet openings in the aerosol provision system (not shown in the figures). A controller of the aerosol provision system is configured to detect the inlet of air, for example based on a change in pressure, and activate the aerosol generating component in response thereto. Thus, an aerosol of the liquid formulation is generated. As air is drawn through the aerosol provision system it carries some of the aerosol through the air channel 520 to the opening 516 in the mouthpiece 514. In this regard, the housing of the aerosol generating area generally has a cross-section that conforms to the cross-section of housing component 510. This allows any aerosol formed in the aerosol generating area to access channel 520

Thus, described above are examples of aerosol provision systems that can help ameliorate the issues discussed above with regard to the generation of degradation products. The following examples serve to illustrate the surprising benefits of the present system.

Examples

An assessment was made of various degradation products that may arise during use of an aerosol provision system. The systems included liquid storage areas where the liquid formulation was held "freely". The systems also included an alumino silicate wool, ceramic fiber membrane (approx. 1 mm thick) from Zibo Dingrong High-Temperature Materials Co. The following formulations were analyzed:

| Formulation 1a-water content 9% w/w | |
|---|---|
| Nicotine strength (% w/w) | 2.5 |
| Glycerol (% w/w) | 63.5 |
| Water (% w/w) | 9.0 |
| PG/Flavour (% w/w) | 25.0 |

| Formulation 1b-water content 9% w/w | |
|---|---|
| Nicotine strength (% w/w) | 2.5 |
| Glycerol (% w/w) | 63.5 |
| Water (% w/w) | 9.0 |
| PG/Flavour (% w/w) | 25.0 |

Formulations 1a and 1b were essentially the same, only differing in the precise flavorant combined with the PG. This variation was not considered to have any effect on the production of degradation products.

| Formulation 2 | |
|---|---|
| Nicotine strength (% w/w) | 1.86 |
| Glycerol (% w/w) | 48.14 |
| Water (% w/w) | 25.0 |
| PG/Flavour (% w/w) | 25.0 |

Protocol:

A number of potential degradation products were monitored during the use of the systems.

Each system was coupled to an automated machine configured to automatically activate the system for a defined period of time (as mentioned below). The activation of the device was then synchronized with an instrument which analyzed the degradation products contained within the aerosol. The aerosol provision system button was held for a total of 4 seconds (corresponding to 1 second pre-puff, 3 second puff) at 30 second intervals, corresponding to a 80 ml volume/3 s duration/30 s interval puffing regime.

The systems were operated for 300 puffs, with the content of degradation products assessed particularly at the end of the puffing regime, i.e. at 251 to 300 puffs. The amount of degradation product was measured in terms of mg/50 puffs.

Results:

As can be seen from Table 1, when Formulation 2 (which contained relatively higher amounts of water—25% w/w) was utilized, the detected degradation products was markedly reduced. Without being bound by theory, this may be down to the formulation being able to pass through the membrane more easily. This may lead to an aerosol generating area that is more consistently dosed with liquid formulation, thereby suppressing the heat of the heater, preventing overheating of the heater which may be responsible for the production of degradation products.

TABLE 1

| | Sample | Formaldehyde | Crotonaldehyde |
|---|---|---|---|
| Formulation 1a (9% water) | 1 | 181.95 | 3.47 |
| | 2 | 4.74 | 8.56 |
| | 3 | 29.40 | 6.32 |
| | Av. | 72.03 | 6.12 |
| Formulation 1b (9% water) | 1 | 56.26 | 1.95 |
| | 2 | 36.65 | 2.79 |
| | 3 | 14.98 | 2.31 |
| | Av. | 35.95 | 5.10 |
| Formulation 2 (25% water) | 1 | 61.65 | 2.69 |
| | 2 | 8.24 | 3.64 |
| | 3 | 4.37 | 2.42 |
| | 4 | 7.51 | 4.76 |
| | 5 | 11.86 | 3.36 |
| | Av. | 18.7 | 3.4 |

Degradation products were measured using liquid chromatography-mass spectrometry.

In order to address various issues and advance the art, this disclosure shows by way of illustration various embodiments in which that which is claimed may be practiced. The advantages and features of the disclosure are of a representative sample of embodiments only, and are not exhaustive and/or exclusive. They are presented only to assist in understanding and to teach that which is claimed. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. An aerosol provision system comprising:

a liquid storage area comprising a liquid formulation;

an aerosol generating area; and a membrane disposed between the liquid storage area and the aerosol generating area to seal the liquid storage area while fluidly communicating the liquid storage area with the aerosol generating area, wherein the liquid formulation has a water content of at least 18% w/w.

2. The aerosol provision system of claim 1, wherein the liquid formulation has a water content of at least 20% w/w.

3. The aerosol provision system of claim 1, wherein the liquid formulation comprises glycerol, propylene glycol, water and nicotine.

4. The aerosol provision system of claim 1, wherein the aerosol generating area comprises an aerosol generating component.

5. The aerosol provision system of claim 4, wherein the aerosol generating component is a heater.

6. The aerosol provision system of claim 1, wherein the membrane is generally planar.

7. The aerosol provision system of claim 1, wherein the membrane has a thickness in the range of 0.1 to 2 mm.

8. The aerosol provision system of claim 1, wherein the aerosol generating area, the membrane and the liquid storage area are generally arranged along a common longitudinal axis.

9. The aerosol provision system of claim 1, wherein the system further comprises a liquid distribution component disposed between the membrane and the liquid storage area.

10. The aerosol provision system of claim 9, wherein the liquid distribution component is generally planar and comprises one or more through holes which allow liquid formulation from the liquid storage area to access the membrane.

11. The aerosol provision system of claim 1, further comprising a body section comprising a power source, a control unit and one or more notification means.

12. The aerosol provision system of claim 11, wherein the power source is rechargeable.

13. The aerosol provision system of claim 11, wherein the body is detachable from the remainder of the system.

* * * * *